United States Patent [19]

Erlendson

[11] 4,263,679

[45] Apr. 28, 1981

[54] HEAD BAND WITH NAPE STRAP

[76] Inventor: Ronald R. Erlendson, 2169-A San Jose Ave., Alameda, Calif. 94501

[21] Appl. No.: 6,540

[22] Filed: Jan. 25, 1979

[51] Int. Cl.[3] ..... A42B 3/00

[52] U.S. Cl. ..... 2/421; 2/420

[58] Field of Search ..... 2/410, 411, 412, 413, 2/414, 415, 416, 417, 418, 419, 420, 424, 425, 8, 6, 10, 421

[56] References Cited

U.S. PATENT DOCUMENTS

| | | | |
|---|---|---|---|
| 3,041,621 | 7/1962 | Brockway | 2/419 |
| 3,354,468 | 11/1967 | Bowers, Jr. | 2/421 |
| 3,388,405 | 6/1968 | Simpson et al. | 2/418 |
| 4,051,555 | 10/1977 | Daly | 2/6 X |

*Primary Examiner*—Peter P. Nerbun

*Attorney, Agent, or Firm*—Flehr, Hohbach, Test, Albritton & Herbert

[57] ABSTRACT

A head band for a hard hat and including a nape strap of a material conforming to the head and held away from the head band against the nape area by two stiff strut members.

4 Claims, 3 Drawing Figures

HEAD BAND WITH NAPE STRAP

BACKGROUND OF THE INVENTION

This invention relates to improvements in hats and caps, and is especially concerned with unique means for retaining hard hats in position on a worker's head when bending over and looking down.

On construction projects of even modest size the regulations of the United States Department of Labor Occupational Safety and Health Administration (OSHA) specify that virtually all workers on the project must wear hard shell safety hats. This regulation is strictly enforced by most all employers in the construction industry and workers found hatless have been fined by the employer for a first violation and summarily fired upon a second violation.

Carpenters and welders, for example, find it necessary on such projects to work in a downwardly facing attitude such as when nailing down a floor or welding seams along a horizontal surface. Their hard hats tend to fall from their heads repeatedly and chin straps are believed unsatisfactory by many workers as being too confining for holding the hard hat in place. Straps extending downwardly along the back of the head in the nape of the neck region are available and are constructed substantially as disclosed in the Bowers Jr. U.S. Pat. No. 3,354,468 issued Nov. 28, 1967. That patent discloses a nape strap formed from flexible material and extends generally along the rear or back of the head band and is shiftable from a raised position where it is tucked away next to the head band to a lowered position of engaging the nape area. This construction is not entirely satisfactory in the field because the unsupported flexible character of the nape strap permits it to work itself upwardly on the head such as when jostling forces are created by the carpenter in a floor nailing operation. Frictional forces between the nape strap and the back of the head above have not proved satisfactory for maintaining the nape strap in a holding relationship with the wearer's head.

Nape straps in combination with chin straps were disclosed in the Alesi U.S. Pat. No. 3,814,043 issued Nov. 26, 1957, and in the Mickel U.S. Pat. No. 3,852,821 issued Dec. 10, 1974. There is in those disclosures no indication of the problem of maintaining the weighty helmet on the head with the nape strap arrangement alone when doing jostling type physical work. Those patents both disclose the suitability of cooperation between the chin strap and the rearwardly positioned nape strap arrangement.

SUMMARY AND OBJECT OF THE INVENTION

In general this invention is for an improved head band which fits into a hard shell safety hat for securely retaining the unit on a worker's head when bending over and looking down. The head band is formed of material conformable to the human head and includes means for supporting it with respect to the hard shell of the hat. A nape strap which is formed of flexible material for conforming to the contour of the nape area of the human head is connected on the left and right side portion of the head band and at least one strut member of relatively stiff material extends downwardly from the rear portion of the head band to a medial section of the nape strap to position positively the nape strap on the head and preferably in the base of the skull area.

An object of the invention is to provide an improved head band for a hard hat which serves to retain the hard hat securely on the head of the workman when bending over and working in a downwardly facing position.

Another object of the invention is to provide a head band structure as described above wherein means are included for locating positively a nape strap in a region low on the head so that the associated hard hat may be held securely on the wearer's head.

Another object of the invention is to provide an improved head band with a positively positioned nape strap which head band arrangement is adaptable to hard hats of different designs.

Another object of the invention is to provide a hard hat and nape strap arrangement which is comfortable to the heads of a wide spectrum of wearers for securing the safety hat in position during vigorous physical work when the head is in a downwardly facing attitude.

These and other objects of the invention will be clearly understood from the drawings which illustrate the invention and the description of it below.

DETAILED DESCRIPTION OF THE INVENTION

Figure 1:
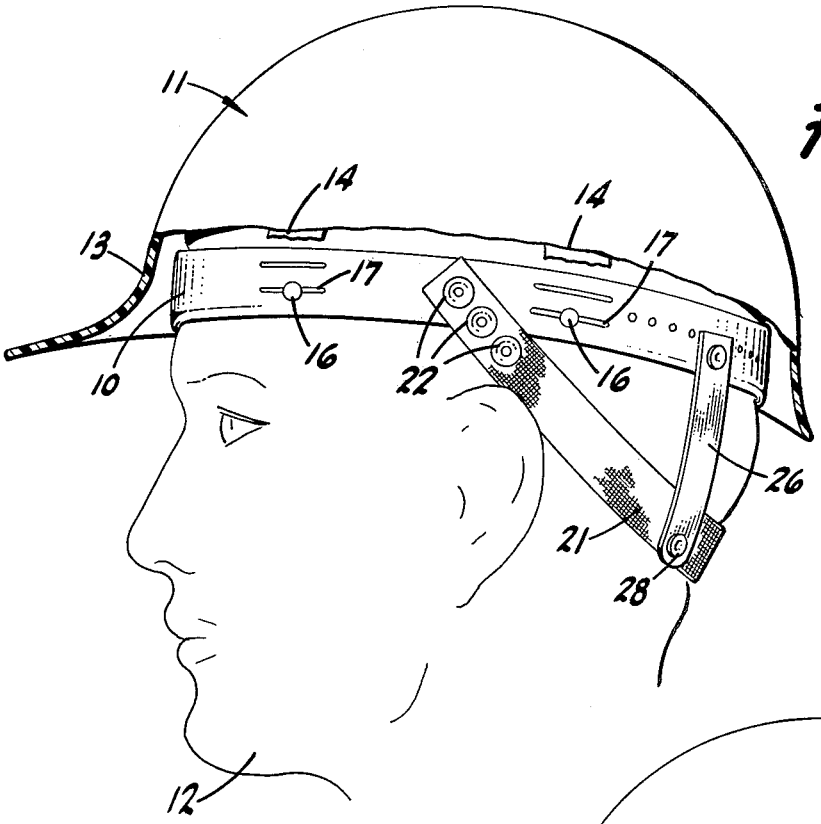
FIG. 1 is a side elevational view of a workman wearing a hard hat, portions of which are broken away to show clearly the head band structure of the present invention.
Figure 2:
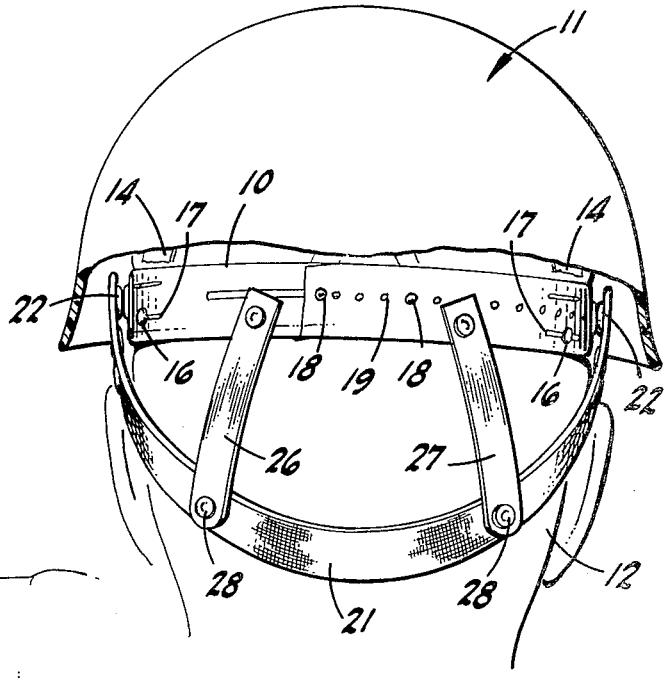
FIG. 2 is a rear view of the structure and head of the person shown in FIG. 2.

An improved head band 10 for a hard shell safety hat 11 is clearly shown in FIGS. 1 and 2 of the drawings in its proper position upon a worker's head 12. The hard hat 11 includes a generally semi-spherical outer shell 13 formed from a high impact plastic material and may be of conventional construction found in the field. To this end the interior of the shell 13 is equipped with circumferentially spaced apart mounting lugs (not shown) for connection with a cooperative fastener (not shown) of a suspension harness 14 which is connected to the head band 10. The construction of the suspension harness 14 and the manner of mounting the head band to the shell 13 may take any of the conventional arrangements found in the field today. It is pointed out here that the head band 10 is adaptable to a large number of suspension harnesses in use.

The head band 10 is connected to the suspension harness 14 at four or more locations, for example, by means of a button 16 fixed to the suspension harness and which extends through an elongated slot 17 in the head band. Two or more spaced slots 17 may be positioned on the width of the head band for adjusting the head band with respect to the suspension harness so that a variety of head sizes and shapes may be accommodated.

The head band extends completely around the wearer's head and for the purposes of this disclosure, locations on the head band will sometimes be referred to by clock positions where the front portion of the head band is considered as the 12 O'clock position and the rear portion opposite it, the 6 O'clock position and so forth. As shown in FIG. 2, adjustment means are provided in the rear 6 O'clock position of the head band and may include a knobbed button 18 selectively positioned in one of a plurality of holes 19 in the ends of the head band to provide adjustability for differing head sizes.

Figure 3:
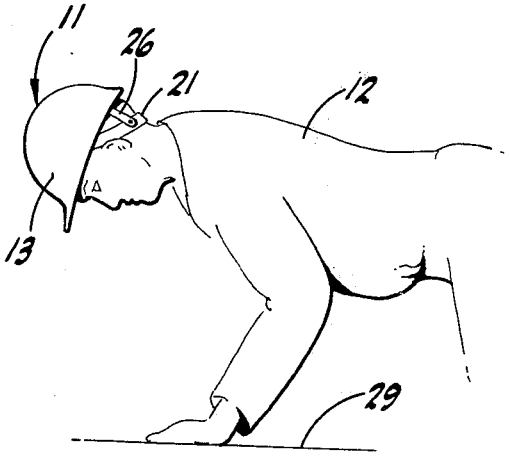
FIG. 3 is a side view on a smaller scale showing a workman in a bent over working position looking downwardly with the head band arrangement of the present invention holding the hard hat securely to his head.

A nape strap 21 formed of flexible material such as webbing, plastic or other suitable material is mounted to the head band 10 at about the 3 O'clock and 9 O'clock positions, as shown in FIGS. 1 and 3. In other words, on opposite sides of the wearer's head at the above-the-ears position. The nape strap 21 droops downwardly in somewhat of a catenary like curve, and has a length ample to extend below the base of the skull and into the nape of the neck area and ideally to engage under the protuberant portion of the rear of the human skull to prevent tipping of the hard hat when the wearer is in the position as illustrated in FIG. 3. Adjustment means are provided on at least one end, and preferably on both ends, of the nape strap 21 and this may take the form of a plurality of snap fasteners 22 with the female portion mounted to the nape strap and the male portion of the head band 10. Snap fasteners sold under the trademark, "DOT" have proved satisfactory in affording adjustability of the nape strap with respect to the head band.

Two relatively stiff strut members 26 and 27 extend from the head band 10 to the nape strap 21, as best shown in FIG. 2. The struts 26, 27 may be formed from a relatively stiff plastic material such as nylon or some other plastic material which can be formed to hold a slight curve so as to accommodate the curvature of the human head. On the head band and on the nape strap 21 the ends of the struts 26, 27 are fixedly secured as by rivets 28 or by a button like fastener (not shown) so as to maintain the nape strap spaced downwardly from the head band. The fastener locations of the struts on the head band are approximately at the 5 O'clock and 7 O'clock positions. The struts diverge outwardly toward the nape strap to about the 4 O'clock and 8 O'clock positions. This arrangement assures that the sides of the head are engaged by the nape strap 21 so that the entire head band and nape strap arrangement will nest firmly but comfortably against the wearer's head for holding the hard shell hat in a secured fashion.

Other arrangements of the relatively stiff strut members will come to mind of those skilled in the field having knowledge of the purpose for retaining the nape strap in a low position on the head.

It has been found that a safety hard hat equipped with a head band arrangement of the disclosure is effective for holding the hard hat on the head of a workman such as a carpenter nailing down a floor as exemplified by FIG. 3. The jostling motion generated in the hammering does not cause the hat to fall unto the floor 129. This arrangement avoids the need for a chin strap which is considered uncomfortable by many workmen.

From the above it is seen that the present invention provides a hat construction of attachement which fully accomplishes the intended objects set out above and is adapted to meet the practical conditions of adjustment in the field by the workmen and installation of the head band unit on a variety of different hard hats.

The present invention is described in detail by way of illustrating it, but it should be understood that certain changes and modifications may be made within the scope of this invention and within the scope of claims which follow below.

What is claimed is:

1. An improved head band for a hard shell safety hat for securely retaining the unit on the worker's head when bending over and looking down, comprising a head band formed of material conforming to the human head and including means for supporting the head band in spaced relation within such hard hat shell, a nape strap formed of flexible material serving to conform to the contour of the nape area of the head, connector means on each the left and right side portion of said head band serving to connect the end portions of said strap to said head band, at least one strut member of relatively stiff material extending between the rear portion of said head band in a curve to a medial section of said nape strap serving to position positively the nape strap low on the head of the wearer and preferably just below the base of the skull, and means on at least one of said head band and strut serving to connect the ends of such strut means to said head band and said nape strap.

2. The combination of claim 1 wherein there are included two spaced apart strut members positioned to extend downwardly and divergingly from the head band to the nape strap.

3. The combination of claim 1 wherein the nape strap is united to said head band at about the 3 O'clock and 9 O'clock position, and a spaced pair of struts mounted on the rear portion of said head band at about the 5 O'clock and 7 O'clock positions.

4. The combination of claim 2 wherein said connector means between the nape strap and head band is constructed and arranged to permit lengthing or shortening of the effective length of the nape strap with respect to the head band.

* * * * *